United States Patent [19]

Grava

[11] 4,342,268

[45] Aug. 3, 1982

[54] VERTICAL STORAGE RACK

[76] Inventor: Alfred Grava, 1616 Sheridan Rd., South Euclid, Ohio 44121

[21] Appl. No.: 56,141

[22] Filed: Jul. 9, 1979

[51] Int. Cl.[3] ..... B65D 19/44

[52] U.S. Cl. ..... 108/55.1; 108/55.3; 211/49 R

[58] Field of Search ..... 108/55.1, 55.3, 51.1; 248/346; 211/49 R, 60 R, 50, 10, 11; 206/386

[56] References Cited

U.S. PATENT DOCUMENTS

| | | | |
|---|---|---|---|
| 1,061,625 | 5/1913 | Morrison | 211/49 R |
| 2,174,715 | 10/1939 | Baker | 211/49 R |
| 2,537,565 | 1/1951 | Wolters | 211/11 |
| 3,187,901 | 6/1965 | Wilson | 211/60 R |
| 3,193,093 | 7/1965 | Hansen | 108/55.1 X |
| 3,561,374 | 2/1971 | Honderich | 108/51.1 |
| 3,737,046 | 6/1973 | Jeter | 211/10 |

FOREIGN PATENT DOCUMENTS

| | | | |
|---|---|---|---|
| 2248204 | 5/1975 | France | 108/56.1 |

*Primary Examiner*—William E. Lyddane

*Attorney, Agent, or Firm*—Pearne, Gordon, Sessions, McCoy & Granger

[57] ABSTRACT

A rack system for vertical storage of sheet stock having structural provisions permitting it to be transported on the forks of a lift truck while loaded. The system is constructed of simple structural shapes and a minimum of fabrication operations, with a resulting savings in manufacturing cost and assured durability.

7 Claims, 3 Drawing Figures

VERTICAL STORAGE RACK

BACKGROUND OF THE INVENTION

The invention relates to material handling and storage, and in particular to a rack system for vertically organizing, storing, and transporting sheet stock.

PRIOR ART

Various storage and display systems for vertically organizing sheet stock have been available. In general, such systems have comprised structures which are expensive to manufacture because of both material and fabrication costs. Further, it would appear in many instances that prior vertical storage racks have been intended to be installed at a point of use permanently, or at least for an indefinite extended period. In many cases, rack storage systems, because of size, weight, or other design criteria, have been impractical to move, particularly when loaded with the extra weight of sheet stock.

SUMMARY OF THE INVENTION

The invention provides a vertical storage rack system having structural provisions making it capable of being conveniently transported even while loaded with sheet stock. The rack system features a plurality of laterally spaced separators defining intervening compartments for reception of vertically oriented sheet stock. The separators are carried on a rigid base which is arranged to be engaged by the forks of a lift truck for transport from location to location.

The disclosed rack system is comprised of standard structural shapes of steel or other metal stock. In accordance with the invention, such structural shapes are cut off to length with little or no subsequent machining, bending, or other fabricating steps except for assembly welding. As a result, the rack system is inexpensive to manufacture and is of rugged, reliable construction. Further, the disclosed arrangement of the various elements of the rack system belies their simple origin and presents a handsome and unimposing appearance particularly suited for retail display. Additionally, the disclosed open network of the separators affords a relatively full view of sheet stock stored in the rack system.

In the preferred embodiment of the rack system, there is provided a base comprised of a plurality of structural channels each inverted and abutting the flanges of adjacent channels. The flanges of these channels form natural legs which, when standing on a floor, enable the forks of a lift truck to be slipped under the channel webs. Each separator is a network formed of bar stock including a continuous, polygonal perimeter portion defining front, top, back, and bottom sections. The bottom separator sections are secured directly to the webs of the channels by welding, so that they are adapted to guide the sheet stock across the channels without binding or jamming. The transition between the front, top, back, and bottom separator sections is accomplished by integral bending in the bar stock which thereby avoids sharp corners and potential hazard to passersby and to stock loaded and unloaded onto the rack system. Excessive bending moments on the separators during manipulation of sheet stock in the rack system are avoided by an inclined area of bar stock truncating the front and top sections of the separator network.

DESCRIPTION OF THE PREFERRED EMBODIMENT

Figure 1:
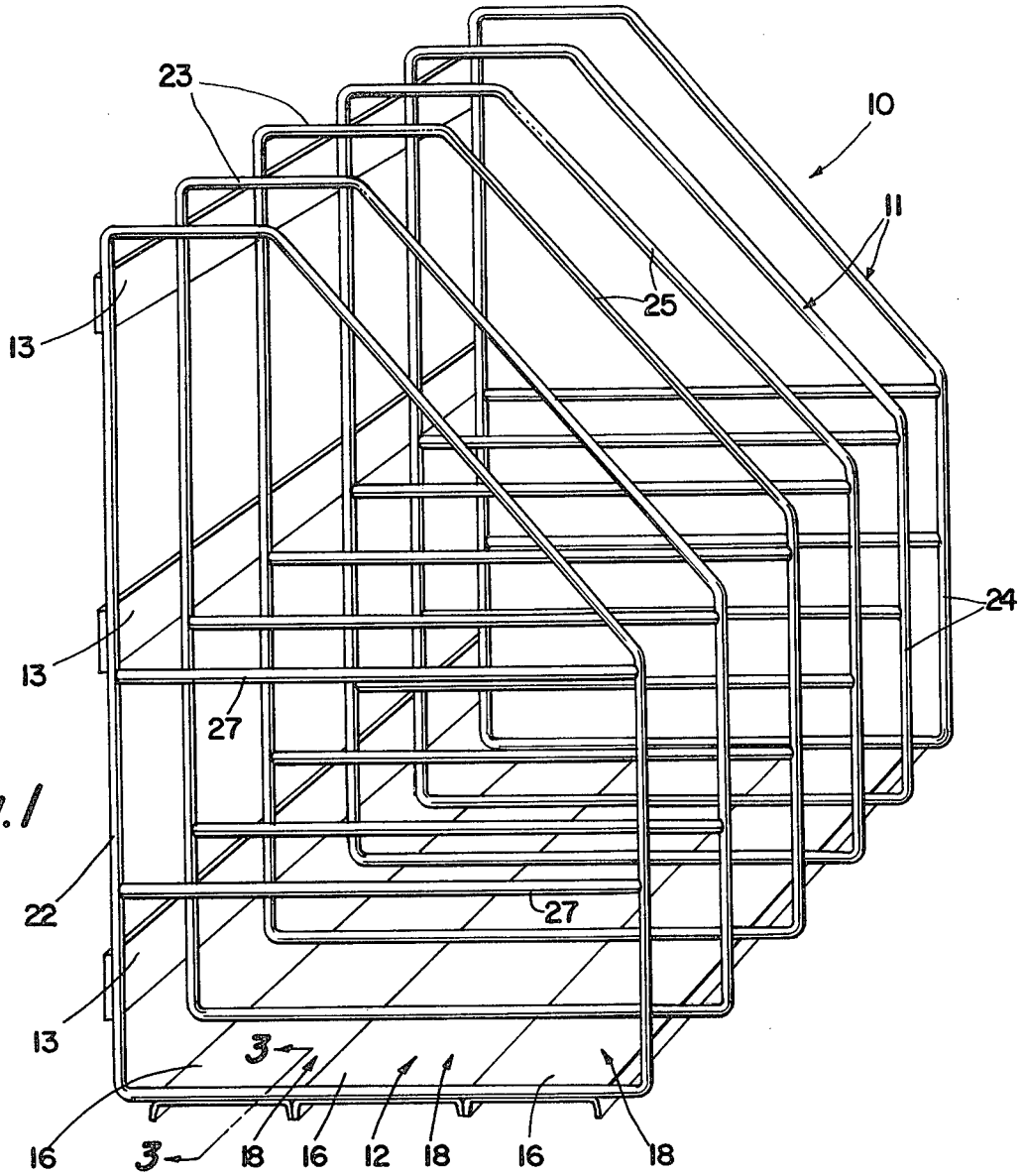
FIG. 1 is a perspective view of a rack system constructed in accordance with the present invention.
Figure 2:
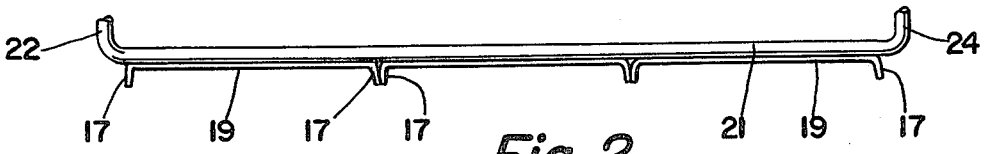
FIG. 2 is a fragmentary side view of a bottom portion of the rack system.

Referring now to the drawing, there is shown a rack system designated generally at 10 adapted to hold sheet stock on edge in a generally vertical orientation. The rack system 10 is a weldment comprising a plurality of separator units 11 fixed to a common base 12 and tied to one another by means of bars 13.

The base 12 is ideally formed of a plurality of standard structural channels 16 each transversely cut off to a uniform length. In the illustrated case, the channels 16 are steel in the form, for example, of 10″×6.5-lb. junior channels. Each channel 16 is, for example, 36″ long. The channels 16 are suitably welded together with their ends aligned, their respective adjacent flanges 17 abutted, and an outer face 18 of their webs 19 in a common plane. With the channels 16 inverted, as shown, the flanges 17 form natural standoff legs for supporting the webs 19 a spaced distance above the floor or ground.

The separators 11 are each preferably fabricated from round, tubular bar stock and in the illustrated case are constructed of standard nominal ½″ ID pipe (having an OD of approximately ⅞″). Each separator 11 includes a polygonal perimeter portion having bottom, back, top, and front sections 21-24, respectively. The perimeter portion is formed of one or more lengths or bar stock, with the ends of such stock abutted and welded to form a continuous loop. In the illustrated example, the outside dimension across the back and front perimeter sections 22-24 is 36″. In this case, the collective surface area of the three 10″ base channels extends substantially from front to back of the rack system. The height of the uppermost surface of the top perimeter section 23 above the ground is, for example, 73½″

The top and front perimeter sections 23,24 are truncated by an inclined section 25 which extends from areas of each of these sections corresponding substantially to the midlengths of the bottom and back sections 21,22, respectively. The bar stock or pipe forming the perimeter of a separator 11 is bent at each intersection between the various sections 21-25 to avoid sharp corners and to simplify construction.

A pair of crossbars or ribs 27 formed of cut-off lengths of bar stock identical to the bar stock forming the perimeter sections 21-24 are welded horizontally between the front and back perimeter sections 24,22. An upper one of the crossbars 27 is disposed approximately at midheight of the rack system so that it intersects at the front substantially adjacent the junction of the front section 24 and inclined section 25.

A lower one of the crossbars 27 is disposed at a height approximately one-quarter that of the height of the top perimeter section 23. The ends of the crossbars 27 are welded directly to the front and back perimeter sections 24,22. It will be understood that the perimeter and crossbars of each separator 11 form a planar network.

Figure 3:
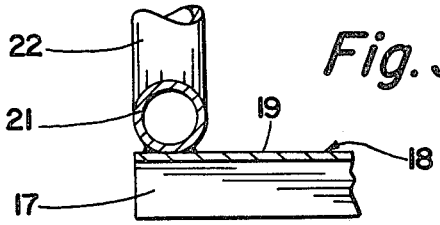
FIG. 3 is a fragmentary, sectional view on an enlarged scale, taken along the line 3—3 of FIG. 1 of a separator and its attachment to a base channel.

The separators 11 are evenly spaced along the length of the base channels 16 in planes normal to the longitudinal direction of these channels. The bottom perimeter section 21 of each separator 11 is welded directly to the outer web surfaces 18 of the channels 16, as indicated in FIG. 3. This bottom perimeter section 21 extends continuously over the abutted base channels 16 and overhangs these channels slightly at the front and rear areas of the rack system.

At a rear face of the rack system 10 a plurality of substantially identical tie bars 13 are provided to stabilize the separators 11 and limit rearward movement of stock stored in the unit 10. Each bar is preferably fabricated from flat steel strip stock, for example 3/16"×3" bar stock transversely cut off approximately to the same length as that of the channels 16. The tie bars or stabilizers 13 are welded in a horizontal attitude to each back section 22 of the separators 11 in a manner similar to the welds between the separators and the channels illustrated in FIG. 3. As indicated, the stabilizer tie bars 13 are vertically spaced along the back separator sections 22 with one adjacent their lower ends, one adjacent their mid area, and one adjacent their upper ends.

Sheet material, such as plywood, wall paneling, and the like, is conveniently organized and stored in the individual spaces or compartments between adjacent separators 11. Such sheet material can be loaded and unloaded from either the front or top of the rack system 10. When loaded from the front, sheets are easily slid across the base 12 without the risk of snagging a corner of the sheet on a discontinuous surface of the base or snagging of a rearward edge of a sheet on a rear perimeter section 22 by guiding functions performed by horizontal parts 21, 25 and 23 of the separators 11. Where the sheet is fully to the rear, further movement is arrested by the full faces of the flat stock tie bars 13 so that local areas of the vertical sheet edges contacting the tie bars are not crushed under excessive compression.

The tendency of sheet stock to lean or sag out of a vertical plane is accommodated without undue strain on its supporting separator 11, since the truncated, inclined section 25 limits bendings moments on the separators which could otherwise be operative at an imaginary point where the front and top perimeter sections 24, 23 would intersect if extended along straight lines.

The disclosed rack system 10 is sufficiently sturdy to be transported or otherwise manipulated with the forks of a lift truck, even when substantially completely loaded with sheet stock. The outermost of the base channels 16 accommodate standard lift trucks with adequate spacing and stability. The height of the flange legs 17 is sufficient to afford easy entry of the forks of such a lift truck under the webs 19. The capacity of the rack system 10 to be transported while loaded is of great advantage, since it permits the rack system to be loaded or unloaded at a point remote from where it is normally stored or displayed. The rack is particularly suited for display as in retail sales, since the open network of the separators 11 affords substantially full inspection of sheets stored in the racks.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A vertical storage system for sheet stock comprising a base and a plurality of laterally spaced separators fixed to and extending upright from the base, the base and separators defining a front, bottom, back, top and sides of the system, the base being formed of a set of inverted metal channels extending longitudinally continuously from one side of the system to the other in the mid-zone between the front and back, a web of each channel being in a common plane and collectively forming a support surface for sheet stock being slid thereon for loading, unloading or storage in the system, the separators being of substantially identical construction, each separator being formed of metal bar stock, the metal bar stock of a separator being fabricated into a generally planar network including a polygonal perimeter portion extending across the top and front of the system, a bottom of the perimeter portion being supported directly on the support surface, means extending across the back of the system tying adjacent separators together, the space between adjacent separators defining sheet receiving compartments, the compartments above the base and forward of the rack being substantially free of obstruction whereby sheet stock may be inserted and withdrawn from the front and top of each compartment and such stock abutting said tying means and resting on said base may extend from said compartments forwardly and upwardly of the front and top of the system during storage, said channels, separators, and tying means being sufficiently rigid to permit said system to be transported by the forks of a lift truck engaging the underside of the webs of the channels.

2. A vertical storage system as set forth in claim 1, wherein said separator perimeter portion is continuous across the back and bottom of said system.

3. A vertical storage system as set forth in claim 2, wherein said separator perimeter portion includes an inclined segment extending between the front and top sections of said perimeter portion.

4. A vertical storage system as set forth in claim 3, wherein said separators include horizontal bars extending between the front and back sections of said perimeter portion and spaced above the bottom of said perimeter portion.

5. A vertical storage system as set forth in claim 2, wherein said typing means is formed of flat metal strip stock aligned in a vertical plane.

6. A vertical storage system as set forth in claim 5, wherein said base channels are abutted at their flanges to provide a substantially continuous support surface.

7. A vertical storage rack for sheet stock comprising a base, a plurality of laterally spaced separators welded to and extending upright from the base, and tie bar means welded to the separators, the base and separators defining front, bottom, back, top, and side sections of the rack, the base including a plurality of inverted metal channels extending longitudinally from one side of the rack to the other, the web of each channel being in a common plane and collectively forming a support surface for sheet stock stored in the rack, the legs of adjacent channels being abutted to thereby avoid gaps in the support surface, the support surface extending over substantially all of the bottom face of the rack, the separators being substantially identical in construction, each separator being formed of metal bar stock, the metal bar stock of a separator being fabricated into a generally planar network including a polygonal perimeter portion extending substantially continuously across the top, front, bottom, and back faces of the rack, the corners of the perimeter portion being formed by intergral bends formed in the bar stock, the bottom of the perimeter portion being supported directly on the support surface, said network including at least one horizontal bar extending from front and back sections of said perimeter portion, the front and top segments of the perimeter portion being truncated by an integral inclined section of bar stock, tie bar means including a continuous flat bar extending horizontally across each of the back separator sections and fixed thereto to tie the separators together, the space between adjacent separators defining sheet receiving slots, the slots above the base and forward of the back being substantially free of obstruction whereby sheet stock may be inserted and withdrawn from the front and top of each slot and such stock abutting said tie bar means and resting on said base may extend from slots forwardly and upwardly of the front and top of the system during storage, said channels, separators, and tie bar means being sufficiently rigid to permit said rack to be transported by the forks of a lift truck engaging the underside of the webs of said channels.

* * * * *